United States Patent [19]

Eppink

[11] Patent Number: 4,676,725

[45] Date of Patent: Jun. 30, 1987

[54] MOINEAU TYPE GEAR MECHANISM WITH RESILIENT SLEEVE

[75] Inventor: Jay M. Eppink, Spring, Tex.

[73] Assignee: Hughes Tool Company, Houston, Tex.

[21] Appl. No.: 814,353

[22] Filed: Dec. 27, 1985

[51] Int. Cl.[4] ..... F01C 1/107; F01C 5/04

[52] U.S. Cl. ..... 418/48; 418/153; 418/178

[58] Field of Search ..... 418/48, 153, 156, 178, 418/182; 175/107

[56] References Cited

U.S. PATENT DOCUMENTS

| | | | |
|---|---|---|---|
| 1,892,217 | 12/1932 | Moineau | 418/48 |
| 3,084,631 | 4/1963 | Bourke | 418/48 |
| 3,499,389 | 3/1970 | Seeberger et al. | 418/48 |
| 4,104,009 | 8/1978 | Chanton | 418/48 |

FOREIGN PATENT DOCUMENTS

| | | | |
|---|---|---|---|
| 2817280 | 10/1979 | Fed. Rep. of Germany | 418/48 |

*Primary Examiner*—John J. Vrablik
*Attorney, Agent, or Firm*—H. Dennis Kelly

[57] ABSTRACT

A gear mechanism, of the Moineau type, having an outer gear member with a helical inner surface. The motor also has a helical inner gear member within the outer member. A resilient sleeve is located between the inner and outer gear members, and has helical inner and outer surfaces. The inner gear member has one less helical thread than the inner surface of the resilient sleeve. The outer surface of the resilient sleeve is similar to, but rotationally offset from, the inner surface of the resilient sleeve.

8 Claims, 5 Drawing Figures

MOINEAU TYPE GEAR MECHANISM WITH RESILIENT SLEEVE

BACKGROUND OF THE INVENTION

1. Field of the Invention

This invention relates to gear mechanisms, and in particular to fluid motors or pumps of the progressive cavity, or Moineau, type.

2. Description of the Prior Art

U.S. Pat. No. 1,892,217 (Moineau) describes a gear mechanism of the Moineau type. This type of mechanism may be used either as a pump or as a fluid motor. The mechanism has two helical gear members disposed within one another. The outer gear member has one helical thread more than the inner gear mechanism. Forcing fluid through the outer gear mechanism will cause the inner mechanism to rotate.

The outer gear mechanism is generally a resilient sleeve, sealingly mounted within a metal body. The interface between the body and the sleeve may be cylindrical or helical. When the interface is helical, the sleeve is usually of a constant thickness, as shown in U.S. Pat. No. 3,084,631 (Bourke).

In U.S. Pat. No. 4,104,089 (Chanton), bosses are added to the inner and outer surfaces of the sleeve. The bosses are located in those areas which correspond to to the highest sliding speeds.

Downhole motors are often used to drill oil wells. In downhole motors of the Moineau type, the outer gear member is a stator and the inner member is a rotor. There must be an interference fit between the rotor surface and the stator surface to provide a pressure seal between the motor stages.

The rubbing of the rotor in the stator, especially in a drilling mud environment, causes the stator surface to wear. The interference and the amount of pressure sealed between the motor stages is thus reduced. A thick resilient sleeve allows much interference between the rotor and the stator, and allows considerable wear of the stator before the pressure seal is reduced to an unacceptable level.

A pressure drop is required across the motor and individually across the motor stages in order to overcome external resisting torque. This places stresses on the resilient sleeve that cause fatigue or hysteresis failures.

The rubbing of the rotor on the stator and the stresses on the stator also cause heat to build up. This heat can also cause the resilient sleeve to break down.

SUMMARY OF THE INVENTION

The gear mechanism of the invention reduces fatigue and heat buildup failures of the stator, and maintains a sufficient amount of wear life. The gear mechanism has a helical rotor within a body with a helical inner surface. A resilient sleeve is mounted between the body and the rotor, and has a helical outer surface and a helical inner surface. The sleeve and the body have one more helical thread than the rotor.

The helical outer surface of the sleeve is rotationally offset from the helical inner surface of the sleeve. This causes the sleeve to be thicker in some areas than in others.

DESCRIPTION OF THE PREFERRED EMBODIMENT

Figure 1:
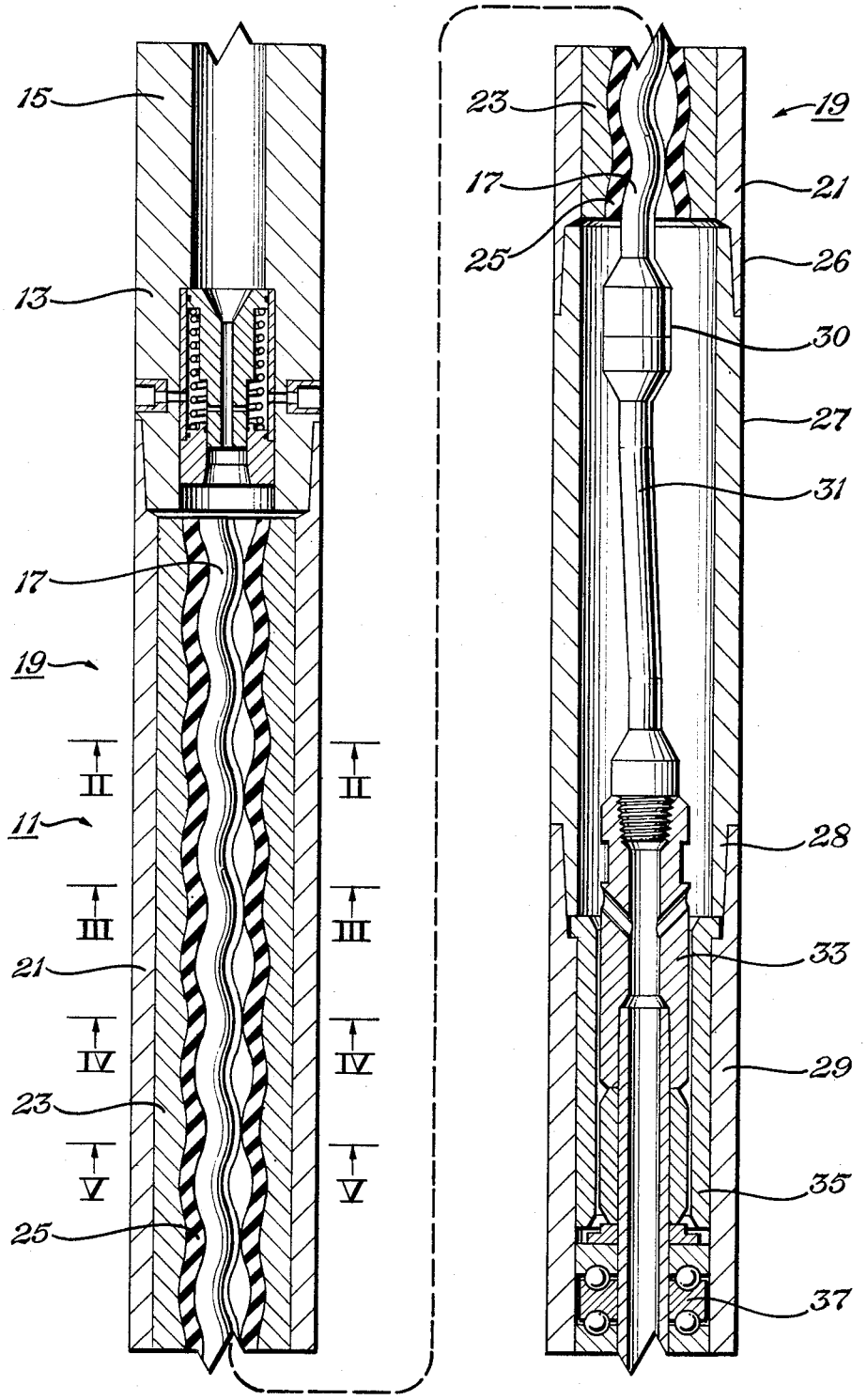
FIG. 1 is a cross sectional view of a downhole drilling motor, a connecting rod, and a bearing pack.

The gear mechanism of the invention can be used as a motor or as a pump. The preferred embodiment is a downhole drilling motor 11, used to rotate an oil well boring rock bit (not shown). The motor 11 is connected to a bypass valve 13, which is connected to the bottom of a drill string 15. The drill string 15 is a series of drill pipe sections and drill collars, and extends up to a drilling rig at the surface.

The motor 11 is a progressive cavity, or Moineau, motor. The motor 11 has a helical inner gear member, or rotor 17, inside an outer gear member, or stator 19. The stator 19 has a cylindrical body 21, a metal sleeve 23, and a resilient sleeve 25.

The lower end 26 of the stator 19 is connected to a connecting rod housing 27, and the lower end 28 of the housing 27 is connected to a bearing pack housing 29. The lower end 30 of the rotor 17 is attached to a connecting rod 31, which is attached to a bearing shaft 33. The bearing pack housing 29 houses a set of radial bearings 35 and a set of thrust bearings 37 between the housing 29 and the bearing shaft 33. The lower end (not shown) of the bearing shaft 33 is connected to a rock bit (not shown).

In accordance with the Moineau principle, the stator 19 has one more helical thread than the rotor 17. In the preferred embodiment, the rotor 17 has a circular cross section, as shown in FIGS. 2–5.

The resilient sleeve 25 has a helical inner surface 39 and a helical outer surface 41. The cross sectional geometry of the inner surface 39 of the resilient sleeve 25 is an oval, defined by a pair of semi-circles 43, connected by a pair of straight lines 45. The outer surface 41 of the resilient sleeve 25 also has an oval cross section, defined by a pair of semi-circles 47 connected by a pair of straight lines 49. The cross sections of the inner and outer surfaces 39, 41 of the resilient sleeve 25 are similar, or in other words, the two cross sections are the same shape, although they are different sizes and orientation.

The metal sleeve 23 has a helical inner surface, which corresponds to the outer surface 41 of the resilient sleeve 25. The outer surface 51 of the metal sleeve 23 is cylindrical, and corresponds to the inner surface of the body 21.

Figure 2:
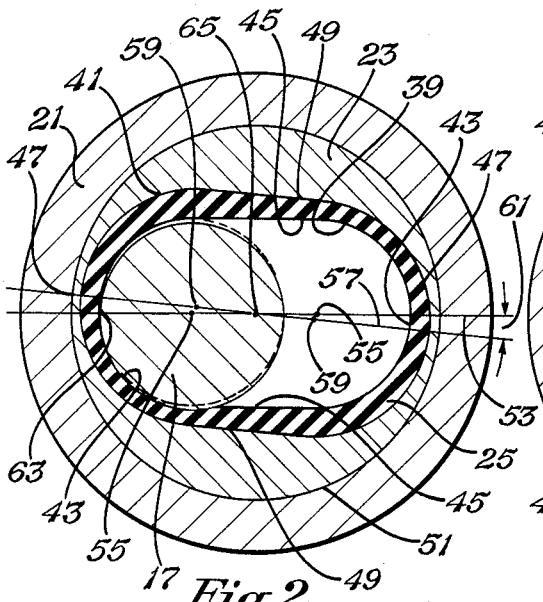
FIG. 2 is a cross sectional view of a downhole motor, as seen along line II—II, in FIG. 1.
Figure 3:
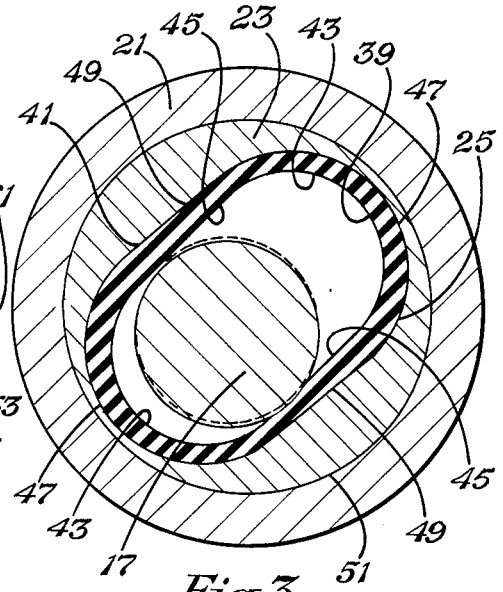
FIG. 3 is a cross sectional view of a downhole motor, as seen along line III—III, in FIG. 1.
Figure 4:
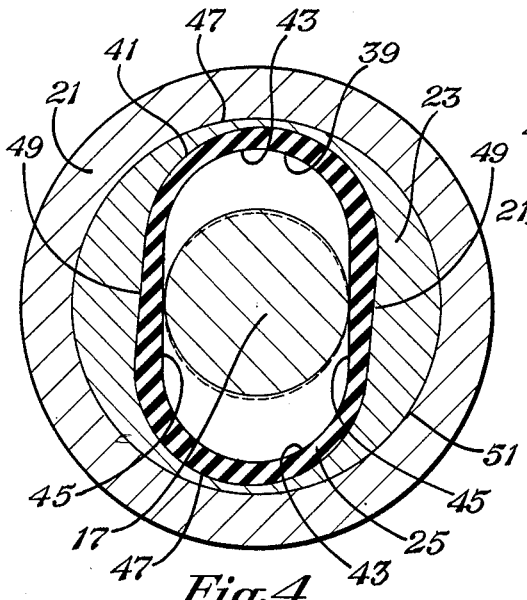
FIG. 4 is a cross sectional view of a downhole motor, as seen along line IV—IV, in FIG. 1.
Figure 5:
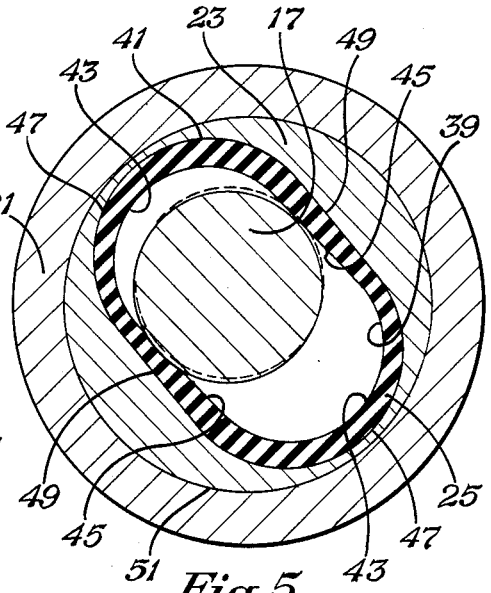
FIG. 5 is a cross sectional view of a downhole motor, as seen along line V—V, in FIG. 1.

As shown in FIG. 2, the inner surface 39 of the resilient sleeve 25 has a longitudinal axis 53, defined as the line which passes through the centers 55 of the two semi-circles 43 which make up the ends of the inner surface 39. The longitudinal axis 53 is also parallel to the two straight lines 45 which connect the semi-circles 43.

The inner surface of the metal sleeve 23 and the outer surface 41 of the resilient sleeve 25 also have a longitudinal axis 57, defined as the line which passes through the centers 59 of the two semi-circles 47 which make up the ends of the outer surface 41. The longitudinal axis 57 is also parallel to the two straight lines 49 which connect the semi-circles 47.

As seen in FIG. 2, the longitudinal axis 53 of the inner surface 39 of the sleeve 25 is offset by an angle 61 from the longitudinal axis 57 of the outer surface 41. This angle 61 of offset remains constant up and down the length of the motor 11. Because of the offset 61, the resilient sleeve 25 is thicker is some areas than in others. A preferred angle 61 of offset will result in certain relationships between various parts of the sleeve 25.

It may be assumed that the thickness of the sleeve 25 at the point 63 farthest away from the center 65 of the cylindrical body 21 is one unit of length. A preferred angle 61 of offset will make the average thickness of the sleeve 25 between the straight line 45, 49 approximately two units. This section of the sleeve 25 will vary from one unit up to three units.

The downhole motor 11 of the invention has several advantages over the prior art. This design makes the sleeve 25 thinnest at the points to which the maximum load is applied by the rotor 17. The thinner parts of the sleeve 25 have a higher modulus of elasticity and can bear higher loads. These thinner parts of the sleeve 25 also help to dissipate heat more quickly. The thicker areas of the sleeve 25, where there is little load from external torque, provide sufficient wear life.

The invention has been shown in only one of its embodiments. It should be apparent to those skilled in the art that the invention is not so limited, but is susceptible to various changes and modifications without departing from the spirit thereof. For example, the helical members of the motor may have any number of helical threads, as long as the rotor 17 has one less helical thread than the inner surface 39 of the sleeve 25. Also, the invention is useful in both motors and in pumps.

I claim:

1. A gear mechanism, comprising:

an outer gear member, having a helical inner surface;

a helical inner gear member, within the outer gear member; and a resilient sleeve, between the inner gear member and the outer gear member, having a helical outer surface and a helical inner surface;

wherein the helical inner gear member has one less helical thread than the helical inner surface of the sleeve;

wherein the cross section of the outer surface of the sleeve is similar to the inner surface of the sleeve; and wherein the helical outer surface of the sleeve is rotationally offset from the inner surface of the sleeve for the entire length of the sleeve.

2. A gear mechanism, comprising:

an outer gear member, having a helical inner surface, with two lobes, so that a cross section of the inner surface of the outer gear member is generally oval and has a longitudinal axis;

a helical inner gear member, within the outer gear member, wherein the inner gear member has a circular cross section; and a resilient sleeve, between the inner gear member and the outer gear member, having a helical outer surface and a helical inner surface, wherein the cross section of the inner and outer surfaces of the sleeve are generally oval and have longitudinal axes;

wherein the longitudinal axis of the cross section of the inner surface of the outer gear member is rotationally offset from the longitudinal axis of the cross section of the inner surface of the sleeve for the entire length of the sleeve.

3. A gear mechanism, comprising:

a stator, having a helical inner surface;

a helical rotor, within the stator; and a resilient sleeve, between the rotor and the stator, having a helical outer surface and a helical inner surface;

wherein the helical rotor has one less helical thread than the helical inner surface of the sleeve;

wherein the cross section of the outer surface of the sleeve is similar to the inner surface of the sleeve; and wherein the helical outer surface of the sleeve is rotationally offset from the inner surface of the sleeve from the entire length of the sleeve.

4. A gear mechanism, comprising:

a stator, having a helical inner surface, with two lobes, so that a cross section of the inner surface of the stator is generally oval and has a longitudinal axis;

a helical rotor, within the stator, wherein the rotor has a circular cross section; and a resilient sleeve, between the rotor and the stator, having a helical outer surface and a helical inner surface, wherein the cross section of the inner and outer surfaces of the sleeve are generally oval and have longitudinal axes;

wherein the longitudinal axis of the cross section of the inner surface of the stator is rotationally offset from the longitudinal axis of the cross section of the inner surface of the sleeve for the entire length of the sleeve.

5. A gear mechanism, comprising:

a cylindrical body;

a metal sleeve, within the body, the metal sleeve having a helical inner surface;

a helical inner gear member, within the metal sleeve; and a resilient sleeve, between the inner gear member and the metal sleeve, having a helical outer surface and a helical inner surface;

wherein the helical inner gear member has one less helical thread than the helical inner surface of the resilient sleeve;

wherein the cross section of the outer surface of the resilient sleeve is similar to the inner surface of the resilient sleeve; and wherein the helical outer surface of the resilient sleeve is rotationally offset from the inner surface of the resilient sleeve for the entire length of the resilient sleeve.

6. A gear mechanism, comprising:

a cylindrical body;

a metal sleeve, within the body, the metal sleeve having a helical inner surface, with two lobes, so that a cross section of the inner surface of the metal sleeve is generally oval and has a longitudinal axis;

a helical inner gear member, within the metal sleeve, wherein the inner gear member has a circular cross section; and a resilient sleeve, between the inner gear member and the metal sleeve, having a helical outer surface and a helical inner surface, wherein the cross section of the inner and outer surfaces of the resilient sleeve are generally oval and have longitudinal axes;

wherein the longitudinal axis of the cross section of the inner surface of the metal sleeve is rotationally offset from the longitudinal axis of the cross section of the inner surface of the resilient sleeve for the entire length of the resilient sleeve.

7. A gear mechanism, comprising:

a cylindrical body;

a metal sleeve, within the body, the metal sleeve having a helical inner surface;

a helical rotor, within the metal sleeve; and a resilient sleeve, between the rotor and the metal sleeve, having a helical outer surface and a helical inner surface;

wherein the helical rotor has one less helical thread than the helical inner surface of the resilient sleeve;

wherein the cross section of the outer surface of the resilient sleeve is similar to the inner surface of the resilient sleeve; and wherein the helical outer surface of the resilient sleeve is rotationally offset from the inner surface of the resilient sleeve for the entire length of the resilient sleeve.

8. A gear mechanism, comprising:

a cylindrical body;

a metal sleeve, within the body, the metal sleeve having a helical inner surface, with two lobes, so that a cross section of the inner surface of the metal sleeve is generally oval and has a longitudinal axis;

a helical rotor, within the metal sleeve, wherein the rotor has a circular cross section; and a resilient sleeve, between the rotor and the metal sleeve, having a helical outer surface and a helical inner surface, wherein the cross section of the inner and outer surfaces of the resilient sleeve are generally oval and have longitudinal axes;

wherein the longitudinal axis of the cross section of the inner surface of the metal sleeve is rotationally offset from the longitudinal axis of the cross section of the inner surface of the resilient sleeve for the entire length of the resilient sleeve.

* * * * *